United States Patent [19]

Kötter

[11] Patent Number: 4,537,218

[45] Date of Patent: Aug. 27, 1985

[54] HYDRAULIC DIRECTIONAL VALVE FOR CONTROLLING DOUBLE-ACTING MOTOR

[75] Inventor: Wolfgang Kötter, Markgröningen, Fed. Rep. of Germany

[73] Assignee: Robert Bosch GmbH, Stuttgart, Fed. Rep. of Germany

[21] Appl. No.: 579,853

[22] Filed: Feb. 13, 1984

[30] Foreign Application Priority Data

Mar. 25, 1983 [DE] Fed. Rep. of Germany ..... 3310863

[51] Int. Cl.[3] ..... F15B 13/08

[52] U.S. Cl. ..... 137/596.13; 91/446

[58] Field of Search ..... 91/446; 137/596.13

[56] References Cited

U.S. PATENT DOCUMENTS 3,415,265 12/1968 Cleminshaw et al. ..... 137/596.13 X 3,901,264 8/1975 Stephens ..... 137/596.12 X

*Primary Examiner*—Gerald A. Michalsky

*Attorney, Agent, or Firm*—Michael J. Striker

[57] ABSTRACT

A hydraulic directional valve for an open circuit and with outwardly adjustable flow regulating valve has a base housing which can be insignificantly changed for different switching of the flow regulating valve so that its adjusting device is always easily accessible, is provided with a bridge passage extending from its central circulating chamber and having two branches with enclosed a feed chamber and extend in auxiliary openings one of which receives a valve insert whereas the other receives a locking plug, and have a transverse opening which connects two constant flow chambers with one another and with an upstream opening of the feed passage from a first embodiment in which a blocking portion obtains the constant stream, and also have a throughgoing feed passage to form a second embodiment in which only one directional valve has the constant stream, and can be provided with different switching options of the flow regulating valve and conversion of the left and right arrangements so that the adjusting device is always easily accessible.

9 Claims, 7 Drawing Figures

HYDRAULIC DIRECTIONAL VALVE FOR CONTROLLING DOUBLE-ACTING MOTOR

BACKGROUND OF THE INVENTION

The present invention relates to a hydraulic directional valve for controlling a double-acting motor with a three-way flow-regulating valve.

Such hydraulic directional valves are known, for example, from U.S. Pat. No. 3,901,264. It is used for controlling in an open circuit a neutral circulating passage which has three chambers and arranged in a housing centrally between the motor chambers and the return chambers. A three-way flow-regulating valve is arranged in the same transverse plane in which the circulating chambers are provided and extends normal to the control slider. An adjusting device associated with the three-way flow-regulating valve extends at the upper side of the valve housing between both motor ports. The disadvantage of this directional valve is that the adjusting device through its length between the pipes extending through the motor ports is poorly accessible. In addition, the upwardly extending adjusting device frequently leads to mounting problems in directional valves. The mutually normal position of the control slider and the flow-regulating valve leads to the fact that the slider openings must be worked in two normally extending axes which is expensive. Furthermore, the normal arrangement leads to a relatively complicated and therefore expensive construction of the flow-regulating valve in which also narrow cross section can take place. The arrangement of the flow-regulating valve has a further disadvantage in that it is poorly suitable for arrangement of auxiliary valves in the region of the motor port. Also, in the known construction, only an equal constant stream can be supplied to the motor ports. In addition, this directional valve has the disadvantage that the constant stream of the flow regulator can be controlled only through the associated directional valve and cannot be available for a block of several directional valves.

U.S. Pat. No. 3,415,265 discloses a hydraulic directional valve in which two motor ports are supplied with a constant stream by three-way flow-regulating valve. In this directional valve the chambers for supply, motor and return are arranged symmetrically to a neutral circulation passage having three chambers, so that the directional valve can be used for a so-called left and right arrangement. The disadvantage of this directional valve is, however, that both flow-regulating valves are arranged in the hollow control slider and therefore are not adjustable from outside. The excessive residual stream of a flow regulator is in addition supplied into the return passage. This directional valve is also not changeable in a simple manner, so that the constant stream of the flow-regulating valve is available for a block of several directional valves.

SUMMARY OF THE INVENTION

Accordingly, it is an object of the present invention to provide a hydraulic directional valve which avoids the disadvantages of the prior art.

More particularly, it is an object of the present invention to provide a hydraulic directional valve in which its adjusting device is easily accessible from outside and also the housing can have the same basic design for both switching types of the flow regulating valve.

This makes possible to form with simple means the basic embodiment of the directional valve in which only the respective directional valve is supplied with a constant stream of the flow regulating valve, or it is also possible to provide such an embodiment in which the constant stream is available for a block of several directional valves.

In each case the residual stream of the flow regulator is supplied into the neutral circulation passage. The adjusting device of the flow regulator is located far from the pipes leading to the motor ports and can therefore be easily controlled. All slider openings in the housing are worked from the same end surface which is very cost-economical. It is also advantageous that extension of the housing in the direction of the longitudinal axis of the control slider is not increased by the arrangement of the flow regulating valve. It is also especially advantageous that this design is suitable for both left and right embodiments.

These objects are attained in accordance with the invention when the housing is provided with two auxiliary openings which are parallel to a longitudinal opening of the slider and extend from both end sides of the housing into a centrally arranged feed chamber, a bridge passage extends from the central circulation chamber and has two branches enclosing the feed chamber therebetween and crossing the auxiliary openings, the constant stream chamber is formed near each branch in the auxiliary opening and communicates with the associated supply chamber, and at least one auxiliary opening receives a valve insert with a hollow slider associated with the outwardly adjustable flow regulating valve.

In accordance with an especially advantageous further feature of the present invention, which provides for favorable mounting of the auxiliary valves, such as blocking valves in the housing in the region of the motor ports, the motor ports on the one hand and the auxiliary openings on the other hand are arranged in the housing relative to the longitudinal opening of the control slider at mutually opposite sides.

Still another feature of the present invention is that the housing at its both flange surfaces is provided with openings associated with the feed passage, the feed passage between both openings is interrupted, the upstream opening is connected with the feed chamber, whereas the downstream opening is connected with a transverse opening which connects both constant stream chambers with one another. In this construction the constant stream of the flow regulating valve is available for a block of several directional valves.

A further feature of the present invention is that the transverse opening which extends between the longitudinal opening and the auxiliary openings parallel to the latter. This provides for a very compact construction.

Still a further feature of the present invention is that in both flange surfaces of the housing the opening associated with the feed passage is arranged, and the openings are connected with one another by the feed passage extending through the feed chamber. This provides for an embodiment in which the constant stream of the flow regulating valve is available for one individual directional valve.

Both constant flow chambers can be connected with one another via a passage and one of the auxiliary openings can receive the valve insert, whereas the other auxiliary opening can be closed by a plug. In such a construction, the constant stream can be controlled to both motor ports.

Finally, an additional feature of the present invention is that each auxiliary opening is closed by a valve insert. In such a construction both motor ports can be provided with different constant streams.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
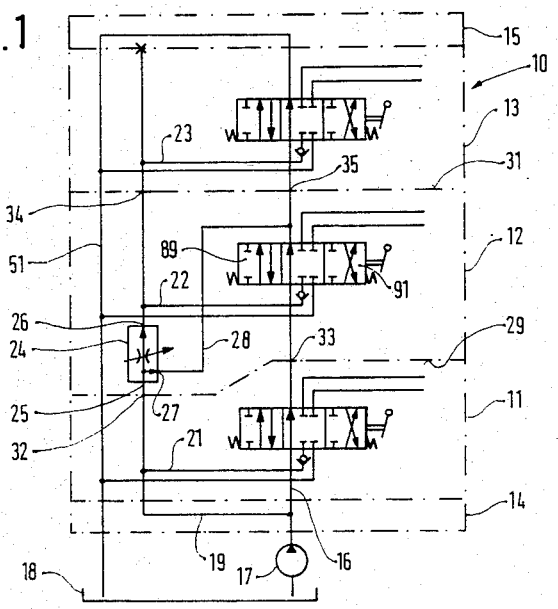
FIG. 1 is a view showing a control arrangement with a directional valve in accordance with a first embodiment of the present invention.

FIG. 1 shows a control arrangement 10 with a first, second and third directional valves 11, 12 and 13 arranged between a closing plate 14 and an end plate 15. All valves 11, 12, 13 are formed as 6/3 valves and connected one behind the other in a neutral circulation passage 16. The circulation passage 16 leads from a pump 17 via the closing plate 14 and the directional valves to the end plate 15 and again back to a tank 18. A feed passage 19 branches from the neutral circulation passage 16 in the closing plate 14, and the individual directional valves 11, 12, 13 are each connected in parallel therewith via a supply passage 21, 22, 23, respectively.

A three-way flow regulating valve 24 is arranged in the feed passage 19 of the directional valve 12 of the present invention and is adjustable from outside. Its inlet 25 is connected with a portion of the feed passage 19, which lies upstream, wherein its constant flow outlet 26 is connected with the feed passage 19 located downstream, so that the supply passages 22 and 23 extend parallel to one another. A residual flow passage 28 leads from a residual flow outlet 27 of the flow regulating valve 24 to the neutral circulating passage 16 in the region between the second and the third directional valves 2 and 13.

The second directional valve 12 is flanged between the first and third directional valves 11 and 13 and has a first flange surface 29 facing toward the first directional valve 11 and a second flange surface 31 facing toward the third directional valve 13. In the first flange surface 29, the feed passage 19 and the neutral circulating passage 16 form respective upstream located openings 32 and 33, whereas the same passage 19 and 16 form in the second flange surface 31 the downstream located openings 34 and 35.

Figure 2:
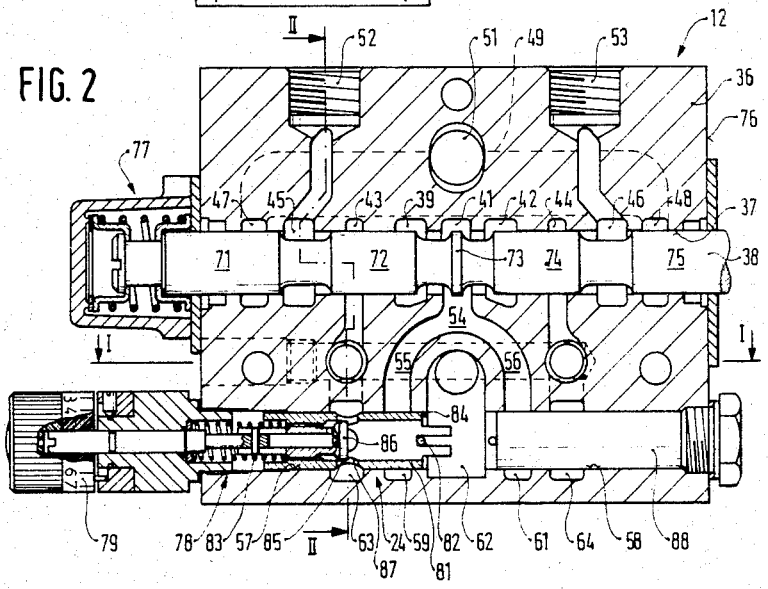
FIG. 2 is a view showing a longitudinal section of the inventive directional valve of FIG. 1.

FIG. 2 is a longitudinal section of the second directional valve 12, which has a housing 36 provided with a throughgoing longitudinal opening 37. A control slider 38 is tightly and slidingly guided in the longitudinal opening 37. The longitudinal openings 37 has ring-shaped increased parts for pressure medium control which form nine chambers. Three chambers located in the central part of the housing 36 are circulation chambers 39, 41, 42 which are associated with the neutral circulation passage 16. As can be seen from FIG. 4, both outer circulation chambers 39 and 42 are connected with the upstream opening 33 in the first flange surface 29, whereas the central circulation chamber 41 is connected with the downstream opening 35 in the second flanged surface 31. The first and second supply chambers 43 and 44, first and second motor chambers 45 and 46, and first and second return chambers 47 and 48 are located at the respective sides of the circulation chambers 39, 41, 42.

As can be seen from FIG. 2, the housing 36 has a bridge passage 54 which extends from the central circulation chamber 41 in a fork-shaped manner and downwardly relative to the longitudinal openings 37 in a direction opposite to the position of motor ports 52 and 53. The bridge passage 54 branches into two branches 55 and 56 whose parallel ends cross a first and a second auxiliary opening 57 and 58 and form there residual flow chambers 59 and 61. Both auxiliary openings 57 and 58 are located in the housing 36 coaxially relative to one another and extend parallel to the longitudinal opening 37. The auxiliary openings 57 and 58 extending from both end sides of the housing end in a feed chamber 62 located in the center. The feed chamber 62 is connected with both branches 55 and 56 and communicate via the openings 32 with the upstream portion of the feed passage 19. A first and a constant stream chamber 63 and 34 are arranged outside of the residual stream chamber 59 and 61. Both auxiliary openings 57 and 58 and both these associated chambers lie symmetrically to the above mentioned central axis.

Figure 4:
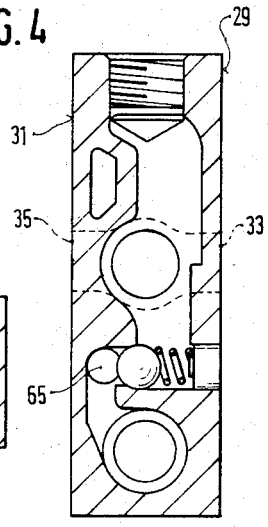
FIG. 4 is a view showing a section taken along the line II—II in FIG. 2.
Figure 3:
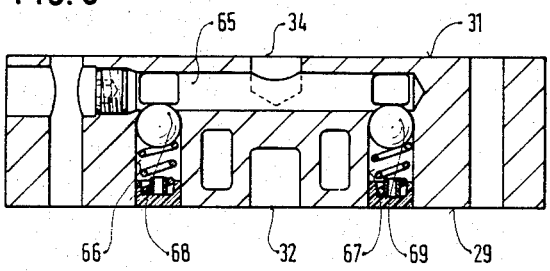
FIG. 3 is a view showing a cross section taken along the line I—I in FIG. 2.

As can be seen from FIG. 2 in connection with FIGS. 3 and 4, both constant flow chambers 63 and 64 are connected with one another with an outwardly closed transverse opening 65. The transverse opening 65 extends in the housing 36 parallel to the longitudinal openings 37 and branches in a region between the longitudinal openings 37 and the auxiliary openings 57 and 58. As can be seen from FIG. 3, downstream portion of the feed passage 19 leads from the transverse opening 55 to the associated openings 34 in the second flange surface 31. Two blind openings 66 and 67 extend from the third-flange surface 29 and are arranged in the housing 36 symmetrically to a central plane. They extend into the transverse opening 65. Both blind openings 66 and 67 receive a first and a second check valve 68 and 69 which secure the associated supply chambers 43 and 44. The third constant stream chamber 63 is in this manner in communication with both supply chambers 43 and 44 via the transverse openings 65 and both check valves 68 and 69. As shown in FIG. 3, the direct connection in the housing 36 between the associated openings 32 and 34 of the feed passage 19 is interrupted.

The control slider 38 movable in the longitudinal opening 37 is formed symmetrically in a known manner and has five piston portions 71, 72, 73, 74, 75. The end portion 75 which extends outwardly beyond the housing 36 is associated with a control side of the directional valve 12, whereas a double-acting return device 77 is associated with the opposite piston portion 71. The control slider 38 holds with its piston portion 72, 73, 74 the neutral circulating passage 16 open in the shown neutral position and hydraulically blocks both motor chambers 45 and 46. During deviation in both sides of the neutral position to working positions, the neutral circulating passage 16 is controlled and one of the supply chambers 43, 44 is connected with the motor chamber 45, 46, whereas the other motor chamber 46, 45 obtains communication with the associated return chamber 48, 47.

A known valve insert 78 is arranged in the housing 36 in the first auxiliary opening 67 and forms a part of the three-way flow regulating valve 24. The valve insert 78 has outwardly extending adjusting device 79 which is screwed in the housing 36 and arranged at the same side at which the double-acting return device 77 is arranged. A hollow slider 81 which serves as a regulating slider belongs to the valve insert 78 and slides in the first auxiliary opening 57. The hollow slider 81 is axially movable by a housing-fixed pin 82, but cannot rotate. The hollow slider 81 lies on the pin 82 under the action of the force of a regulating spring 83 in its initial position, and it interrupts with its control edge 84 the communication from the feed chamber 62 to the first residual flow chamber 54. The hollow slider 81 is open at its end side to the feed chamber 62 and is provided in the region of the first constant flow chamber 63 with radial control openings 85. A throttle piston 86 adjustable from above by the adjusting device 79 forms an adjustable orifice 87.

A locking plug 88 is arranged in the second auxiliary opening 58. It separates the feed chamber 62 from the second residual flow chamber 61 and from the second constant flow chamber 64 and blocks the same outwardly.

The operation of the directional valve 12 inside the control arrangement 10 is explained now in detail with reference to FIGS. 1–4.

When the control slider 38 of the second directional valve 12, similarly to the control slider of the other directional valves 11 and 13, are located in the respective central position, the pressure medium supplied from the pump 17 flows via the neutral circulation passage 16 to the end plate 15 and via the return passage 51 back to the tank 18. In the directional valve 36 both branches 55 and 56 of the bridge passage 54 are blocked at one end by the hollow slider 81 of the flow regulating valve 24 and on the other hand by the locking plug 88.

When only the control slider 38 of the second directional valve 12 displaces to the right in its first working position 89, the control slider 38 interrupts the neutral circulation passage 16. The pump supplies now the pressure medium into the feed passage 19, which flows via the opening 32 in the first flange surface 29 into the feed chamber 62. From there the pressure medium flows through the hollow slider 81 and via the orifice 87 into the first constant stream chamber 63 and further via the first check valve 68 into the first supply chamber 43, as well as via the first motor chamber 45 to the first motor port 52. The amount of this constant stream which flows to the motor port 52 can be varied from outside with the aid of the adjusting device 79 by adjusting the orifice 87. Simultaneously, the residual stream flowing over the constant stream into the branch 55 of the bridge passage 54 is controlled when the control edge 84 on the hollow slider 81 controls the connection from the feed chamber 62 to the first residual flow chamber 59. This residual flow travels from the bridge passage 54 further into the central circulation chamber 41 and thereby to the downstream opening 35 of the neutral circulation passage in the second flange surface 31 and further via the open neutral circulation passage 16 into the third directional valve 13 back to the tank 18. When the first motor port 52 is supplied with a constant stream, the pressure medium coming from the consumer flows simultaneously from the second motor port 53 via the second motor chamber 46, the second return chamber 48, the transverse passage 49 and the return passage 51 to the tank 18.

When the control slider 38 of the second directional valve 12 moves from its central position to the left, in its second working position 91, the second motor port 53 is supplied with constant stream in the respective manner, whereas the first motor port 52 is unloaded to the tank 18. The constant flow which arrives from the feed chamber 62 via the flow regulating valve 24 into the first constant stream chamber 63, flows via the transverse opening 65 and the second check valve 69 into the second supply chamber 54. No pressure medium can flow via the downstream openings 34 in the second flange surface 31, since the downstream portion of the feed passage 19 as well as the supply passage 23 are hydraulically blocked through the third directional valve 33. Also in the second working position 91 flows the residual pressure medium stream controlled from the flow regulating valve 24 via the circulation chamber 41 in the neutral circulation passage 16 to the tank 18.

When only the third directional valve 13 is actuated, the consumer associated with the same is also supplied with a constant stream from the flow regulating valve 24 via the third supply channel 23. Since the neutral circulation passage 16 in the third directional valve 13 is interrupted and thereby also the residual flow passage 28 is hydraulically blocked, the flow regulating valve 24 operates only as a two-way regulating valve. Moreover, both directional valves 12 and 13 are simultaneously actuated, and in a known manner first the consumer with a lower loading pressure is supplied.

Figure 5:
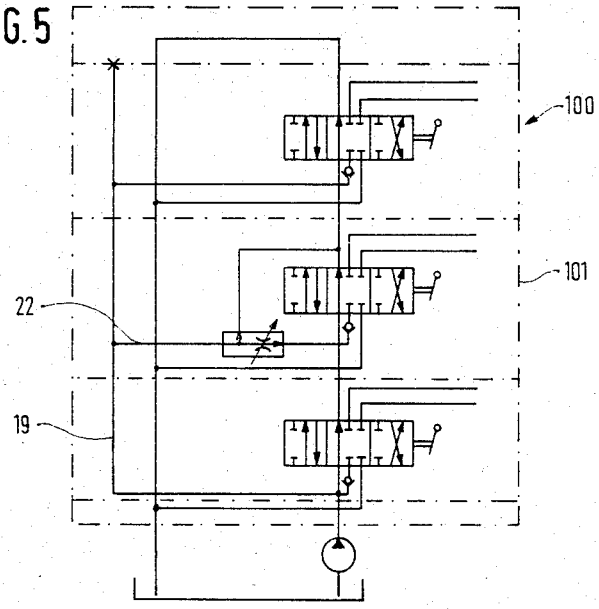
FIG. 5 is a view showing a control arrangement with a directional valve in accordance with a second embodiment of the present invention.

FIG. 5 shows a second control arrangement 100 with an inventive second directional valve 101 which differs from the second directional valve 12 of FIG. 1 in some features.

In the second directional valve 101, the flow regulating valve 24 is no longer connected with the feed passage 19, but instead is connected with the stitch-shaped supply passage 22 which extends from the feed passage 19. In this manner the constant stream of the flow regulating valve 24 is supplied to the second directional valve 101.

Figure 6:
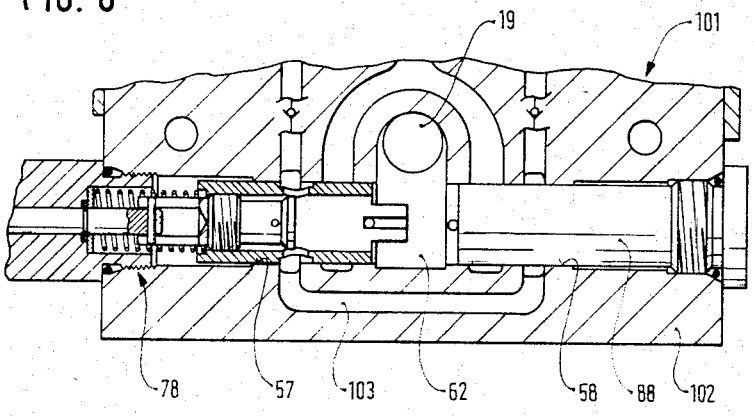
FIG. 6 is a partial section of the inventive directional valve of FIG. 5.

FIG. 6 shows a partial longitudinal section of the second directional valve 101. Its housing 102 differs from the housing 36 of the second directional valve 12 in that the feed passage 19 extending through the feed chamber 62 is formed as one throughgoing opening which connects with one another both associated openings 62 and 64 in the flange surfaces 29 and 31. Since this feed passage 19 can now be formed as a throughgoing passage, the functions of the transverse openings 65 in the housing 36 of FIG. 2 are now performed by a constant flow passage 103 which connects with one another both constant flow chambers 63, 64. This passage 103 lies under the auxiliary openings 57 and 58.

The operation of the second directional valve 101 inside the second control arrangement 100 differs from the operation of the second directional valve 12 in the control arrangement 10 in that the constant flow of the flow regulating valve 24 is associated with only one directional valve 101.

Figure 7:
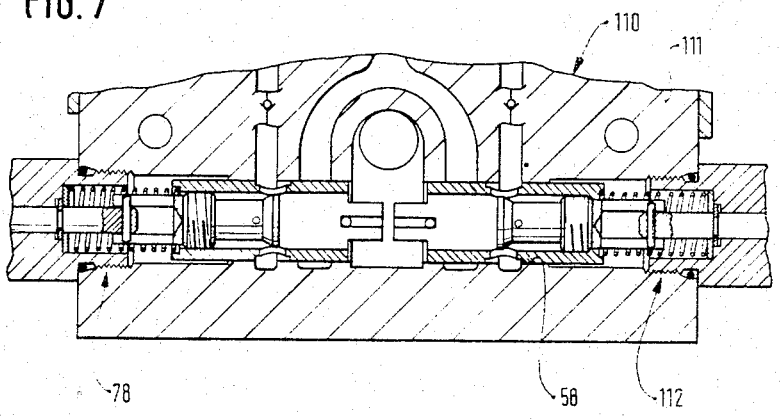
FIG. 7 is a partial longitudinal section of a directional valve in accordance with a third embodiment of the present invention.

FIG. 7 shows a partial longitudinal section of a third embodiment of a second directional valve 110. The directional valve 110 has a housing 111 which differs from the housing 101 of the embodiment of FIG. 6 in that there is no constant flow passage 103 in the housing. Instead of the locking plug 88 in the second auxiliary opening 58, a second valve insert 112 is provided. Thus, for both motor ports 52 and 53 differently great constant streams are adjustable. In all other aspects, the operation of the directional valve 110 corresponds to the operation of the directional valve 101.

The above described directional valves 12, 101, 110 can be implemented in advantageous manner by insignificant changes in the same base housing in such a manner that two different switching arrangements of the flow regulating valves are possible, and their adjusting device is easily accessible from outside. It is further advantageous that the directional valves 12 and 101 from the shown left embodiment are easily convertible into a right embodiment, so that the accessibility of the adjusting device 79 is obtained. When the right embodiment the return device 77 lies against the housing end side associated with the piston portion 75, the valve portion 78 can also be arranged in the second residual opening 58 and the first residual opening 57 can receive a locking plug 88. The arrangement of the flow regulating valve and the motor port at opposite sides relative to the control slider 38 provide in the region of the motor port a sufficient space so as to arrange their auxiliary valves such as for example a blocking valve in the housing. Furthermore, because of the throughgoing design of the longitudinal opening 37 and the arrangement of such auxiliary openings 57 and 58, the present invention deals with a cost-economical, easily manufactured solution. The utilization of a valve insert with the hollow slider 81 allows a compact variable design and avoids multiple guides of the hollow slider. In an embodiment in which a constant stream must be provided for only one individual directional valve, it is possible by different constant streams for both motor ports to provide a free selection of the speed of the forward and return movements. This can be done by a simple exchange of a locking plug with a second valve insert.

It will be understood that each of the elements described above, or two or more together, may also find a useful application in other types of constructions differing from the types described above.

While the invention has been illustrated and described as embodied in a hydraulic directional valve, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A hydraulic directional valve for controlling a double-acting motor, comprising a housing having a center and two end sides; a longitudinal opening formed in said housing; a neutral circulating passage for flowing a pressure medium flow from a pump to a tank, said neutral circulating passage being formed symmetrically and having three chambers including a circulating chamber; a plurality of chambers formed in said housing and being in operative communication with said longitudinal opening, said chambers including two motor chambers, two supply chambers, and two return chambers; the control slider axially movable in longitudinal opening between a neutral position in which said control slider controls said neutral circulating passage and separates said two motor chambers from a respective one of said supply chambers and a respective one of said return chambers, and two working positions in which said control slider blocks said neutral circulating passage and connects one of said motor chambers with one of said supply chambers and the other motor chamber with one of said return chambers; an outwardly adjustable three-way flow regulating valve extending between a feed passage arranged in said housing and said supply chambers and supplying the latter with a constant stream, whereas its residual stream is supplied into one of said circulating chambers of said neutral circulating passage located downstream; two auxiliary openings extending in said housing parallel to said longitudinal opening from both end sides of the housing, a feed chamber arranged in the center of said housing so that said auxiliary openings extend into said feed chamber; a bridge passage extending from a central one of said circulating chambers and having two branches enclosing said feed chamber therebetween and crossing said auxiliary openings; two constant stream chambers each formed near a respective one of said branches in each auxiliary opening and connected with the associated supply chambers; and a valve insert with a hollow slider associated with said outwardly adjustable flow regulating valve and arranged in at least one of said auxiliary openings.

2. A hydraulic directional valve as defined in claim 1; and further comprising motor ports provided in said housing, said motor ports and said auxiliary openings being arranged relative to said longitudinal opening at opposite sides relative to one another.

3. A hydraulic directional valve as defined in claim 1, wherein said housing has two flanged surfaces each provided with openings each arranged at a respective one of said flange surfaces and associated with said feed passage, said feed passage being interrupted between said openings, and said openings including an upstream opening connected with said feed chamber, and a downstream opening, said housing also having a transverse opening with which said downstream opening communicates and which connects both constant stream chambers with one another.

4. A hydraulic directional valve as defined in claim 3, wherein said transverse opening extends between said longitudinal opening and said auxiliary openings and is parallel to the latter.

5. A hydraulic directional valve as defined in claim 1, wherein said housing has two flange surfaces and is provided with two openings each provided in the respective flange surface and associated with said feed passage, said feed passage extending through said feed chamber and communicating said openings with one another.

6. A hydraulic directional valve as defined in claim 5, wherein said housing has a passage which connects said constant stream chambers to one another; and further comprising a plug closing the other of said auxiliary openings.

7. A hydraulic directional valve as defined in claim 5; and further comprising a further valve insert arranged in the other of said auxiliary openings.

8. A hydraulic directional valve as defined in claim 1, and further comprising check valves each provided in a respective one of said supply chambers and arranged between said control slider and said auxiliary openings, said housing having flanged surfaces having open blind openings which accomodate said check valves.

9. A hydraulic directional valve as defined in claim 1; ,and further comprising an adjusting device for said flow regulating valve and a return device for said control slider, said adjusting device and said return device being located at the same end side of said housing.

* * * * *